United States Patent [19]

Barboza

[11] Patent Number: 4,957,786

[45] Date of Patent: Sep. 18, 1990

[54] METHOD OF MAKING DOLL AND DOLL THEREBY FORMED

[76] Inventor: Lorraine Barboza, 75 N. Main St., Assonet, Mass. 02702

[21] Appl. No.: 472,302

[22] Filed: Jan. 30, 1990

[51] Int. Cl.[5] ..... A63H 3/16; B32B 31/10

[52] U.S. Cl. ..... 428/16; 29/805; 156/61; 156/63; 156/91; 156/293; 428/7; 434/82; 446/388; 446/488

[58] Field of Search ..... 29/805; 156/61, 63, 156/91, 293; 428/3, 7, 16, 542.2, 542.6; 434/82; 446/388, 488

[56] References Cited

U.S. PATENT DOCUMENTS

| | | | |
|---|---|---|---|
| 3,264,160 | 8/1966 | Donofrio | 428/16 X |
| 3,841,019 | 10/1974 | Lorenzo | 428/16 X |
| 4,192,903 | 3/1980 | Tremblau | 428/3 X |
| 4,321,291 | 3/1982 | Brownell | 428/16 |
| 4,333,974 | 6/1982 | Davis | 428/16 |
| 4,670,070 | 6/1987 | Reed | 156/61 |

*Primary Examiner*—Robert A. Dawson
*Attorney, Agent, or Firm*—Salter & Michaelson

[57] ABSTRACT

A method of making a doll includes the steps of forming a skirt portion from a substantially circular, flat, formable sheet by cutting three closely spaced substantially parallel radially extending slits in the sheet, forming the main portion of the sheet into a substantially conical configuration, and bending the elongated strips defined by the slits outwardly in opposite directions so that the main portion of the sheet and the bases of the strips define an aperture in the skirt portion. The method further includes the steps of forming a character figure portion including head, neck and body portions, and assembling the character figure portion with the skirt portion so that the body portion is received in the interior of the conical skirt portion and so that the neck portion extends through the aperture in the skirt portion to position the head portion above the skirt portion.

12 Claims, 2 Drawing Sheets

METHOD OF MAKING DOLL AND DOLL THEREBY FORMED

BACKGROUND AND SUMMARY OF THE INVENTION

The instant invention relates to dolls and more particularly to a method of making a unique ornamental doll and to a doll made in accordance with the method.

Ornamental dolls of various types have been found to be highly popular with children as well as with many adults. In this regard, it has been found that many children and adults enjoy collecting interesting and attractive dolls, particularly those dolls which are highly ornamental in appearance. However, because most of the heretofore available ornamental dolls have been constructed with various relatively complicated manufacturing processes they have generally been relatively expensive. Further, because most of the heretofore available ornamental dolls have been constructed in automated assembly processes they have not been readily adapted for wide varieties of ornamental constructions in relatively small scale operations.

It has generally been found that various household items can be utilized for making dolls and ornaments of various types in small scale operations. For example, it has been found that dolls comprising skirt portions made from the lids of metal cans which have been formed into generally conical configuration can be made in small scale operations and provide interesting and ornamental dolls. However, the previously known procedures for forming the skirt portions and the remaining components of dolls of this general type as well as the previously known procedures for assembling the remaining components of dolls with the skirt portions thereof have generally been less than effective do to the relatively difficult problem of securing the head and body portions of dolls of this type to the skirt portions thereof.

The instant invention provides an effective method of forming a doll of the general type comprising a skirt portion which is formed from a substantially circular formable sheet, such as the metal lid of a can. Specifically, the method of the instant invention comprises the steps of forming a skirt portion from a substantially circular, substantially rigid, thin, formable sheet by cutting three closely spaced, substantially parallel slits in the sheet which extend inwardly to substantially the center thereof. The slits are formed so that they define a pair of elongated narrow strips and so that the remainder of the sheet defines a main portion of substantially circular configuration. The sheet is then further formed by bending the main portion thereof into a partially conical configuration wherein at least the outermost portions of the edges of the main portion defined by the slits are in closely adjacent relation. The strips are then bent outwardly in opposite directions in spaced relation to the outer surface of the main portion so that the connected ends of the strips and the edges of the main portion defined by the slits cooperate to form an aperture in the sheet. The main portion of the sheet is then preferably crimped to further form it into an at least partially corrugated configuration and thereafter a fabric material is preferably applied to the outer surfaces of the main portion.

In the next step of the method a character figure portion is formed to include a body portion which is dimensioned to be received in the interior of the conical main portion of the skirt portion, a head portion, and an elongated neck portion extending between the head portion and the body portion. The body portion is preferably made from a formable material, such as styrofoam, and a fabric material is preferably applied to the outer surfaces of the body portion. The head portion is preferably of substantially spherical configuration and it has a reduced opening therethrough and the neck portion is preferably made from an elongated piece of wood, such as a wooden match stick. The neck portion is preferably assembled with the body portion by applying an adhesive to the neck portion and then inserting the neck portion into the body portion so that it penetrates the material of the body portion to adhesively secure the neck portion to the body portion. The neck portion is preferably adhesively secured to the head portion so that the neck portion extends into the opening in the head portion. In addition, the character figure portion preferably includes a hat portion on the head portion, and the hat portion is preferably made from a fabric material and secured to the head portion by passing an elongated pin having an enlarged head thereon through the hat portion, through the opening in the head portion along with the wooden neck portion and then into the body portion. The pin preferably comprises a pearl pin to provide an ornamentation on the hat portion and the head portion is preferably decorated with conventional facial markings.

In the next step of the method the character figure portion is assembled with the skirt portion so that the body portion is received in the interior of the skirt portion and so that the neck portion extends through the aperture in the skirt portion to position the head portion above the skirt portion. This is preferably carried out by separating the rear corner portions of the main portion of the skirt portion slightly and then passing the neck portion of the character figure portion into the aperture in the skirt portion so that the body portion is received in the conical main portion of the skirt portion and so that the head portion is disposed above the skirt portion. This can normally be done by separating the rear corner portions of the skirt portion slightly without actually bending the skirt portion so that the skirt portion resiliently returns to its original position after the neck portion has been passed into the aperture in the skirt portion.

It has been found that the method of the instant invention can be effectively utilized for forming attractive ornamental dolls. In this regard, by forming a character figure portion so that it includes an elongated neck portion and by then assembling the character figure portion with a skirt portion so that the neck portion passes through an aperture in the skirt portion, it is possible to effectively assemble the various components of the doll in a simple assembly operation without gluing or otherwise securing the various components, such as the head portion and the body portion directly to the skirt portion. As a result, complicated and potentially messy assembly techniques wherein the body portion and the head portion are adhesively secured to the skirt portion can be avoided and the character figure portion can be effectively assembled and secured to the skirt portion of the doll.

Accordingly, it is a primary object of the instant invention to provide an effective and practical method of making a doll of the general type comprising a skirt portion made from a substantially circular thin formable sheet.

Another object of the instant invention is to provide an effective method of forming a doll comprising a skirt portion made from a substantially circular thin formable sheet wherein a character figure portion comprising a body portion, a head portion and a neck portion is assembled with the skirt portion so that the neck portion of the body portion extends through an aperture in the skirt portion.

Other objects, features and advantages of the invention shall become apparent as the description thereof proceeds when considered in connection with the accompanying illustrative drawings.

DESCRIPTION OF THE DRAWINGS

In the drawings which illustrates the best mode presently contemplated for carrying out the present invention.

DESCRIPTION OF THE INVENTION

Figure 1:
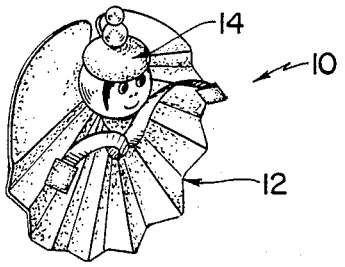
FIG. 1 is a perspective view of a doll made by the method of the instant invention.
Figure 2:
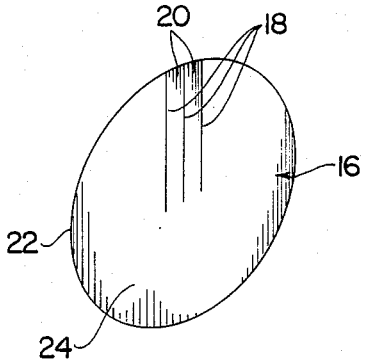
FIGS. 2–4 illustrate the steps of forming a skirt portion of the doll in accordance with the method.
Figure 3:
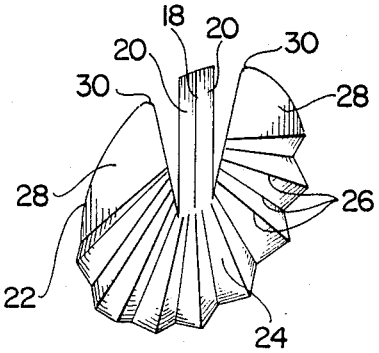
Figure 6:
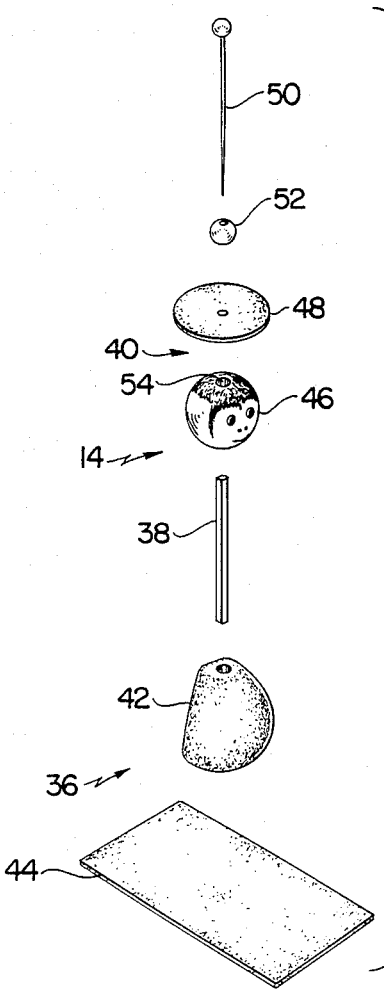
FIG. 6 is an exploded perspective view of a character figure portion of the doll.
Figure 7:
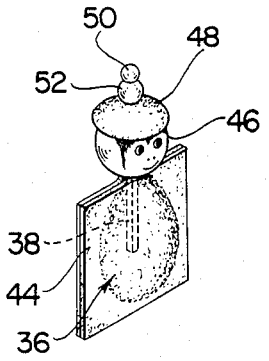
FIG. 7 is a perspective view of a fully formed character figure portion.

Referring now to the drawings, the ornamental doll of the instant invention is illustrated and generally indicated at 10 in FIG. 1. The doll 10 which comprises a skirt portion generally indicated at 12 and a character figure portion generally indicated at 14 is assembled in accordance with the method of the instant invention as illustrated in FIGS. 2–7. More specifically, the doll 10 is formed by forming the skirt portion 12 in accordance with the method as illustrated in FIGS. 2–5, forming the character figure portion 14 in accordance with the method as illustrated in FIGS. 6 and 7 and assembling the character figure portion 14 with the skirt portion 12.

Figure 4:
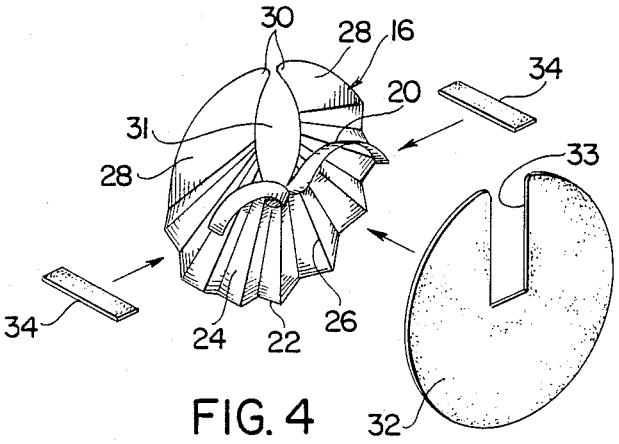
Figure 5:
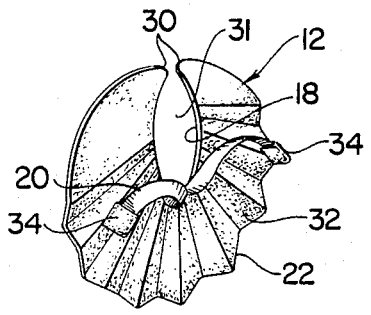
FIG. 5 is a perspective view of a fully formed skirt portion.

Referring to FIGS. 2–5, the skirt portion 12 is preferably formed from a substantially circular, substantially rigid, thin formable sheet 16 which preferably comprises a metal top from a conventional metal can. In order to form the skirt portion 12, three substantially parallel elongated slits 18 are first formed in the sheet 16 so that the slits 18 extend inwardly to substantially the center of the sheet 16 to define a pair of elongated strips 20. The sheet 16 has a circumferential perimeter 22 and it includes a main portion 24 which is defined by the perimeter 22 and the outermost slits 18. The main portion 24 is preferably bent or crimped along a plurality of bend or fold lines 26 to form the main portion 24 into a partially corrugated configuration. The bend lines 26 radiate outwardly from substantially the center of the main portion 24 and substantially flat terminal or rear tab portions 28 having rounded outer ends or corners 30 are provided in the main portion 24 adjacent the rear or outermost portions of the outermost slits 18. The strips 20 are bent or curled outwardly in opposite directions to the configurations illustrated in FIG. 4 and the main portion 24 is formed into a substantially conical configuration by drawing the tab portions 28 inwardly and together so that the ends 30 are in closely adjacent relation as illustrated in FIG. 4. Once the sheet 16 had been bent and formed in this manner the connected ends of the strips 20 and the edges of the main portion 24 defined by the outermost slits 18 cooperate to define an aperture 31 in the skirt portion 12. After the sheet 16 has been formed into a substantially conical configuration a decorative fabric 32 is adhesively secured to the outwardly facing surface of the main portion 24 and reduced sheets 34 of fabric material are adhesively secured to the strips 20 so that they extend around the terminal end portions of the strips 20.

The character figure portion 14 is preferably formed in the manner illustrated in FIGS. 6 and 7 and it preferably comprises a body portion assembly generally indicated at 36, a neck portion 38 and a head portion assembly generally indicated at 40. The body portion assembly 36 comprises an inner body element 42 which is preferably made from a penetrable material, such as polystyrene foam, and dimensioned and configured to be received in the interior of the conical skirt portion 12. The body portion assembly 36 further comprises a fabric layer 44 which is adhesively secured to the outer surfaces of the inner body element 42. The neck portion 38 comprises an elongated member which is preferably made from a rigid material, such as a suitable wood. For example, it has been found that the neck portion 38 can be effectively constructed from an element, such as a wooden match stick. The neck portion 38 is assembled with the body portion 36 so that the lower portions of the neck portion 38 penetrate the inner body element 42. Further, the neck portion 38 is preferably adhesively secured to the inner body element 42 to effectively retain it in assembled relation therewith. The head portion assembly 40 comprises a substantially spherical head element 46, a hat element 48, a pearl pin 50 and a bead 52. The head element 46 has a reduced opening 54 therethrough and it preferably has suitable facial markings thereon. The hat element 48 is preferably of substantially circular configuration and it is preferably also made from a suitable fabric material. The head portion assembly 40 is preferably assembled with the neck portion 38 and the body portion assembly 36 so that the bead 52 is received on the pearl pin 50 and so that the pearl pin 50 passes through the hat portion 48 and through the opening 54. The neck portion 38 is preferably adhesively secured in the opening 54 along with the pearl pin 50 and the pearl pin 50 preferably extends along the neck portion 38 and into the inner body element 42.

The character figure portion 14 is assembled with the skirt portion 12 so that the body portion assembly 36 is received in the interior of the conical main portion 24 of the skirt portion 12 and so that the neck portion 38 passes upwardly through the aperture 31 to position the head portion assembly 40 above the skirt portion 12 adjacent the base of the center slit 18 where the strips 20 merge with the main portion 24. This is preferably accomplished by separating the ends 30 slightly and then passing the neck portion 38 inwardly into the aperture 31 through the gap defined by the separated ends 30. Thereafter, the separated ends 30 are preferably either resiliently returned to their original positions or again bent inwardly and together to close the perimeter of the aperture 31. Alternatively, however, the character figure portion 14 can be assembled with the skirt portion 12 by passing the neck portion 38 through the aperture 31 prior to assembling the neck portion 38 with either the head portion assembly 40 or the body portion assembly 36.

It is seen therefore that the instant invention provides an effective method of constructing an ornamental doll. The character figure portion 14 is effectively assembled with the skirt portion 12 so that the head portion assembly 40 and the body portion assembly 36 are effectively retained in assembled relation with the skirt portion 12 but so that the head portion 40 and the body portion 36 nevertheless have a limited degree of freedom of movement. Further, the head portion assembly 40 and the body portion assembly 36 are effectively assembled with the skirt portion 12 without potentially messy and time consuming adhesive connections between the head portion assembly 40 and the skirt portion 12 or between the body portion assembly 36 and the skirt portion 12. Further, because of the overall simplicity of the assembly procedures required for constructing the skirt portion 12 and the character figure portion 14 as well as the relatively simple procedures required for assembling the skirt portion 12 with the character figure portion 14, the doll 10 can be effectively and efficiently constructed from relatively inexpensive materials to provide a relatively inexpensive yet highly attractive ornamental doll. Accordingly, for these reasons it is seen that the subject invention represents a significant advancement in the doll art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A method of making a doll comprising the steps of:

(a) forming a skirt portion from a substantially circular, substantially rigid, thin, formable sheet by cutting three closely spaced substantially parallel slits in said sheet, said slits extending inwardly in said sheet to substantially the center thereof and defining a pair of elongated narrow strips, the remainder of said sheet defining a main portion having a substantially circumferential perimeter and first and second substantially radially extending inner edges, forming said main portion into an at least partially conical configuration wherein the portions of said first and second inner edges which are adjacent said perimeter are in closely adjacent relation, and bending said strips outwardly in opposite directions in spaced relation to the outer surface of said main portion so that the connected ends of said strips and said inner edges cooperate to define an aperture in said skirt portion;

(b) forming a character figure portion including a body portion which is dimensioned and configured to be received in the interior of said main portion, a head portion and an elongated neck portion extending between said body portion and said head portion;

(c) assembling said character figure portion with said skirt portion so that said body portion is received in the interior of said skirt portion and said neck portion extends through said aperture to position said head portion above said skirt portion.

2. In the method of claim 1, said step of forming said character figure portion further comprising applying a fabric to the outer surface of said body portion.

3. In the method of claim 1, said step of forming a character figure portion comprising the steps of forming a character figure portion body portion from a penetrable material, forming an elongated substantially rigid neck portion, securing said head portion to said neck portion, applying an adhesive to said neck portion, and inserting said neck portion into said body portion so that it penetrates said penetrable material to adhesively secure said neck portion to said body portion.

4. In the method of claim 3, said body portion being made of polystyrene foam.

5. In the method of claim 3, said neck portion comprising an elongated wooden member.

6. In the method of claim 1, said sheet material further characterized as a sheet metal, said step of forming said skirt portion further comprising the step of crimping said main portion to form said main portion into an at least partially corrugated configuration.

7. In the method of claim 5, said neck portion being made from a wooden match stick.

8. In the method of claim 3, said step of forming said character figure head portion further characterized as forming a substantially spherical character figure head portion having a reduced opening therethrough, said step of securing said head portion to said neck portion further characterized as assembling said head portion on said neck portion so that said neck portion is received and secured in said opening.

9. In the method of claim 8, said step of forming a character figure portion further comprising the steps of forming a hat portion, assembling said hat portion on said head portion and inserting a pin element having an elongated head portion through said hat portion so that said pin element is received in said opening along with said neck portion.

10. In the method of claim 9, said pin element also passing into said body portion adjacent said neck portion.

11. In the method of claim 10, said neck portion being made from a match stick, said pin element further characterized as a pearl pin.

12. A doll formed by the method of claim 1.

* * * * *